US007789473B2

(12) United States Patent
Loewen

(10) Patent No.: US 7,789,473 B2
(45) Date of Patent: Sep. 7, 2010

(54) MULTI-SECTION CABINET

(76) Inventor: James M. Loewen, 712 Ffith Ave. #2, Venice, CA (US) 90291

( * ) Notice: Subject to any disclaimer, the term of this patent is extended or adjusted under 35 U.S.C. 154(b) by 637 days.

(21) Appl. No.: 11/725,413

(22) Filed: Mar. 19, 2007

(65) Prior Publication Data

US 2007/0216266 A1 Sep. 20, 2007

Related U.S. Application Data

(60) Provisional application No. 60/782,875, filed on Mar. 17, 2006.

(51) Int. Cl.
*A47B 81/00* (2006.01)

(52) U.S. Cl. ..... 312/283; 108/149

(58) Field of Classification Search ..... 312/285, 312/128, 202, 304, 305, 135, 283; 108/149, 108/150; 248/323, 324, 328, 317; 211/113, 211/115, 116, 117, 118, 119

See application file for complete search history.

(56) References Cited

U.S. PATENT DOCUMENTS

| | | | | | |
|---|---|---|---|---|---|
| 241,123 | A | * | 5/1881 | Danner | 312/249.2 |
| 1,227,723 | A | * | 5/1917 | Wilson | 108/164 |
| 1,330,181 | A | * | 2/1920 | Gibbs | 312/329 |
| 1,347,936 | A | * | 7/1920 | Carroll | 52/31 |
| 2,512,465 | A | * | 6/1950 | Moorhouse | 312/125 |
| 2,543,263 | A | * | 2/1951 | Vanderveld et al. | 312/107 |
| D201,331 | S | * | 6/1965 | Ullmann | D6/457 |
| 3,820,861 | A | * | 6/1974 | Crosslen | 312/123 |
| 3,844,230 | A | * | 10/1974 | Hudson et al. | 108/60 |
| 3,961,830 | A | * | 6/1976 | Gosswald | 312/135 |
| 4,121,720 | A | * | 10/1978 | Hayes | 211/113 |
| D266,466 | S | * | 10/1982 | Winter et al. | D6/473 |
| 4,625,874 | A | * | 12/1986 | Abe et al. | 211/122 |
| 4,643,496 | A | * | 2/1987 | Dahl | 312/299 |
| 4,660,728 | A | * | 4/1987 | Martin | 211/118 |
| 4,821,888 | A | * | 4/1989 | Hankes | 211/1.56 |
| 4,850,658 | A | * | 7/1989 | Sandor | 312/225 |
| 4,938,549 | A | * | 7/1990 | Potter | 312/305 |
| 5,065,872 | A | * | 11/1991 | Simon | 211/122 |
| 5,088,604 | A | * | 2/1992 | Baur et al. | 211/1.55 |
| 5,088,619 | A | * | 2/1992 | Shank | 220/532 |
| 5,305,890 | A | * | 4/1994 | Ishikawa | 211/122 |
| 5,335,985 | A | | 8/1994 | Baur | |
| 5,370,255 | A | * | 12/1994 | Yang | 220/4.27 |
| D361,219 | S | * | 8/1995 | Luymes | D6/432 |
| 5,690,399 | A | | 11/1997 | Davis | |
| 5,735,414 | A | * | 4/1998 | Lo | 211/162 |
| 5,749,137 | A | * | 5/1998 | Martin | 29/434 |
| D428,754 | S | * | 8/2000 | Marquez, Jr. | D6/630 |
| D433,264 | S | * | 11/2000 | Lindeqvist et al. | D6/631 |
| 6,375,285 | B1 | * | 4/2002 | Choi | 312/202 |
| 6,419,332 | B1 | | 7/2002 | Caldwell, Jr. et al. | |
| 6,425,647 | B1 | * | 7/2002 | Pothin | 312/249.2 |
| 6,588,865 | B2 | | 7/2003 | Caldwell, Jr. et al. | |

(Continued)

*Primary Examiner*—Darnell M Jayne
*Assistant Examiner*—Michael Calabrese

(57) ABSTRACT

A cabinet, having a cabinet-section assembly including a circuit of four, interconnected, square cabinet sections arranged around a central pole. The cabinet sections are suspended from a hub that is free to rotate atop the central pole. The suspension system biases the cabinet-section assembly toward either an open configuration, exposing open sides of the cabinet sections, or a closed configuration from intermediate configurations. A stabilizing bracket provides lateral support to the suspended cabinet-section assembly.

14 Claims, 2 Drawing Sheets

U.S. PATENT DOCUMENTS 6,814,418 B2 * 11/2004 D'Orso ..... 312/351
6,951,374 B2 10/2005 Swenson
7,000,798 B2 * 2/2006 Gruennert et al. ..... 220/495.09

* cited by examiner

MULTI-SECTION CABINET

This application claims the benefit of U.S. provisional Application No. 60/782,875, filed Mar. 17, 2006, which is incorporated herein by reference for all purposes.

The present invention relates generally to cabinets of various types and, more particularly, to a carousel cabinet configured for to provide holding audio and audiovisual media, or other household items.

BACKGROUND OF THE INVENTION

Storage cabinets are frequently used to store many types of items, such as compact discs, digital video disks, videocassette recorder tapes, books, spices, cosmetics, and a variety of other items of all shapes and sizes. Typical storage cabinets have a plurality of vertically spaced shelves encased in a box-shaped structure with an opening on one lateral side. One or more hinged doors are typically arrayed over the opening to provide convenient access to the items when needed, while keeping them from view and protecting them from dirt and dust the rest of the time.

For some types of storage cabinets, it is recognized that high-density storage within an aesthetically pleasing structure is useful for keeping numerous items of interest handy within the home or office. For example, it is considered preferable to have high-density storage for compact discs in a pleasant looking cabinet near a home stereo. It is known for such a structure to include not only shelving within the main box of the structure, but also shelving on the doors. Such a cabinet stores items two rows deep (the first row being in the door), and when opened doubles in width to display all the items.

It is also known to store items in storage cabinets having complex mechanical or electromechanical item retrieval systems. Such cabinets can be expensive to manufacture, and can have reliability issues.

There exists a need for convenient, compact, cost efficient, aesthetically pleasing and dense cabinet design for storing articles. Preferred embodiments of the present invention satisfy these and other needs, and provide further related advantages.

SUMMARY OF THE INVENTION

In various embodiments, the present invention solves some or all of the needs mentioned above, typically providing a cabinet that can densely store goods in a simple, aesthetically pleasing device that turns inside out to provide good access to all its contents.

The cabinet of the present invention typically includes a cabinet-section assembly and a support body. The cabinet-section assembly includes a plurality of cabinet sections, each cabinet section defining a first and second hinge line. Each cabinet section, at its first hinge line, is hingedly attached to another cabinet section at its first hinge line, and each cabinet section, at its second hinge line, is hingedly attached to another cabinet section at its second hinge line. The plurality of cabinet sections form a complete circuit of interconnected cabinet sections, wherein the cabinet-section assembly is characterized by a first configuration, a second configuration, and a range of configurations intermediate the first and second configurations. The first and second configurations are different from one another, and are each characterized by the cabinet sections being drawn fully toward a central axis of the cabinet-section assembly.

The cabinet features a support body configured to support the cabinet-section assembly, and to bias the cabinet-section assembly to move to either the first configuration or the second configuration from every configuration intermediate the first and second configurations. Advantageously, this makes the cabinet easy to open by simultaneously turning each cabinet section inside out with respect to the other cabinet sections. In this open position, the storage may be accessed from more than one side, and thus access is relatively easy. Because of the gravitational bias, the cabinet requires no latches or catches, magnetic or otherwise, to remain in its open position or closed position.

The invention further features that the support bias is gravitationally driven by a suspension mechanism. Advantageously, this provides for the device to be simple in form, reliable, and easy to manufacture.

The invention further features that the cabinet-section assembly is configured to rotate with respect to the support body to facilitate access to all sides of the cabinet. It also features stabilizing brackets configured to provide lateral support to the cabinet-section assembly during opening or rotation.

Other features and advantages of the invention will become apparent from the following detailed description of the preferred embodiments, taken with the accompanying drawings, which illustrate, by way of example, the principles of the invention. The detailed description of particular preferred embodiments, as set out below to enable one to build and use an embodiment of the invention, are not intended to limit the enumerated claims, but rather, they are intended to serve as particular examples of the claimed invention.

DETAILED DESCRIPTION OF THE PREFERRED EMBODIMENTS

Figure 1:
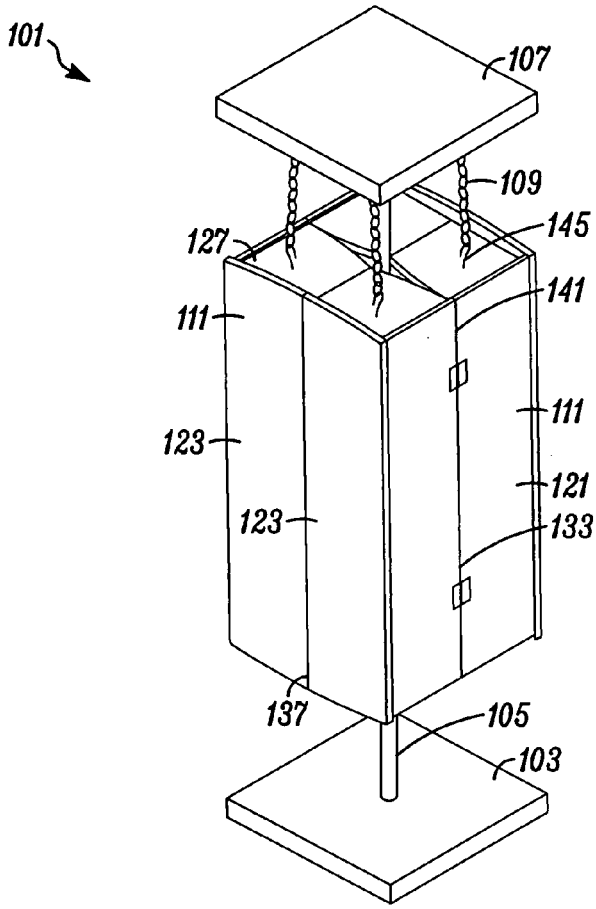
FIG. 1 is a perspective view of a cabinet in a closed configuration, the cabinet embodying the present invention.
Figure 2:
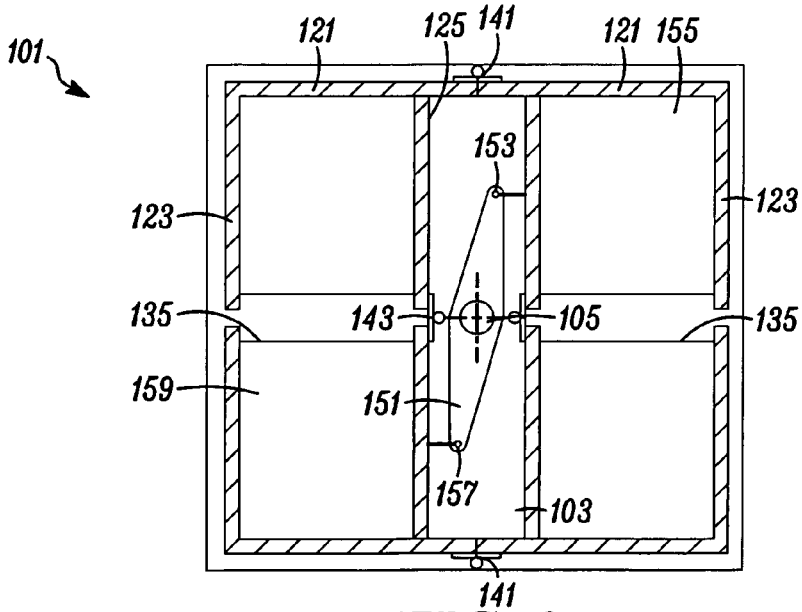
FIG. 2 is a cross-section plan view of the cabinet of FIG. 1.

The invention summarized above and defined by the enumerated claims may be better understood by referring to the following detailed description, which should be read with the accompanying drawings. This detailed description of particular preferred embodiments of the invention, set out below to enable one to build and use particular implementations of the invention, is not intended to limit the enumerated claims, but rather, it is intended to provide particular examples of them.

Typical embodiments of the present invention reside in a cabinet that includes a cabinet-section assembly suspended from a hub of a stand, where the cabinet-section assembly is biased to move between configurations characterized by open-faced cabinet sections and closed-faced cabinet sections.

With reference to FIGS. 1-4, a first embodiment of a cabinet 101 under the invention is provided with a support body assembly including a base 103, a central pole 105, a hub 107 and four connectors 109. The cabinet is also provided with a cabinet-section assembly including four cabinet sections 111 and eight hinges 113. The bias mechanism of the cabinet is gravitationally driven, and thus the various components of the cabinet may be defined in terms of a vertical dimension.

However, it should be understood that other embodiments of the invention may include bias mechanisms that are not gravitationally driven, and are not limited by the references to a vertical dimension for the present embodiment.

Each cabinet section 111 is provided with a back panel 121, an exterior side panel 123, an interior side panel 125, a top panel 127, a plurality of intermediate shelves 129, and a bottom panel 131 that also serves as a bottom shelf. A lateral back edge of the exterior side panel 123 intersects with the back panel 121 along an exterior lateral edge of the back panel. Likewise, a lateral back edge of the interior side panel 125 intersects with the back panel near an interior lateral edge 133 of the back panel.

A front face 135 of the cabinet section 111 extends between a lateral front edge 137 of the exterior side panel 123 and a lateral front edge 139 of the interior side panel 125. The back panel 121, side panels 123 and 125, top panel 127 and bottom panel 131, in combination, have inner surfaces that define an open-faced interior for the cabinet section. The plurality of intermediate shelves 129 divide the interior into a plurality of cavities, each cavity being open along the front face 135 of the cabinet section.

Each cabinet section 111 defines a first hinge line 141 and second hinge line 143, the first and second hinge lines being parallel and extending in the vertical direction. The first hinge line 141 extends along the interior lateral edge 133 of the back panel 121, which is approximately along the lateral back edge of the interior side panel 125. The second hinge line 143 extends along the lateral front edge 139 of the interior side panel 125. Thus, the first hinge line and the second hinge line extend parallel to one another on opposite edges of one of the lateral sides of each cabinet section.

The cabinet section is thus characterized by four lateral sides (i.e., the front face, the back panel, and the two side panels) that are parallel to the first and second hinge lines, and are in a substantially square configuration, three of these lateral sides being closed and one being open. The cabinet section is further characterized by a top side and a bottom side that are normal to the first and second hinge lines and on opposite vertical ends of the four lateral sides.

At its first hinge line 141, each cabinet section 111 is hingedly attached by two of the eight hinges 113 to another cabinet section at the cabinet section's first hinge line. Likewise, at its second hinge line 143, each cabinet section is hingedly attached by two of eight hinges to yet another cabinet section at its second hinge line. As a result, all four of the cabinet sections are hingedly connected by eight hinges to form a complete circuit of interconnected cabinet sections. The distance between the two hinge lines of each cabinet section is equal.

In the discussion above, the terms interior and exterior are defined in terms of a closed configuration of the cabinet-section assembly, as will be further discussed below. As is apparent in the figures, two of the cabinet sections are identical in configuration, and are a mirror image of the other two cabinet sections. Each cabinet section is hingedly attached to two other cabinet sections at its two hinge lines, and is a mirror image to each of these two cabinet sections.

Figure 3:
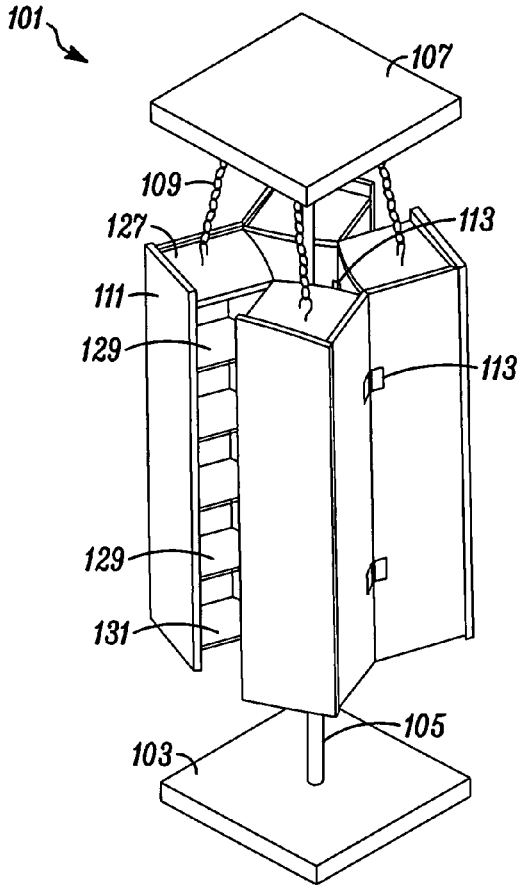
FIG. 3 is a perspective view of the cabinet of FIG. 1, in an intermediate configuration.
Figure 4:
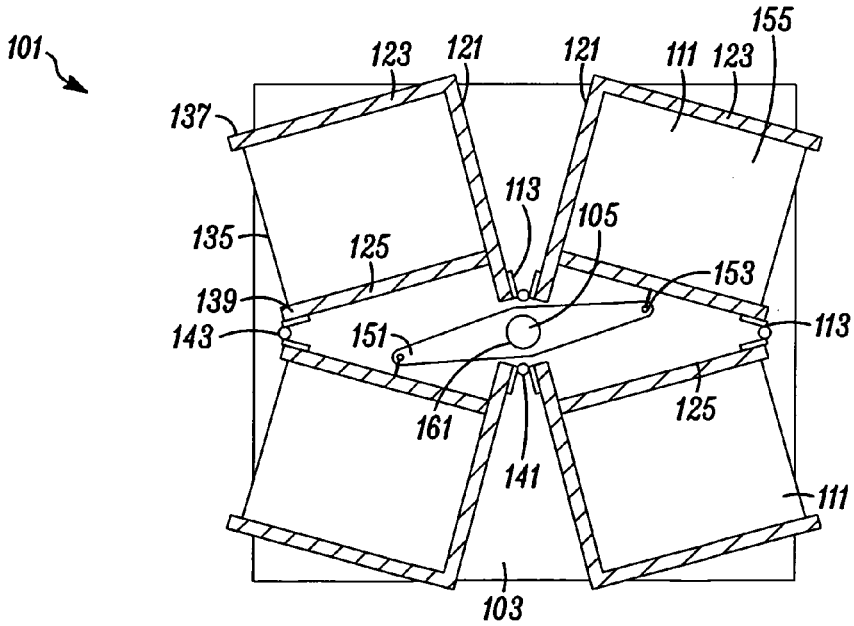
FIG. 4 is a cross-section plan view of the cabinet of FIG. 1, in an open configuration.

The cabinet-section assembly is characterized by a first, closed configuration (depicted in FIGS. 1 and 2), a second, open configuration (depicted in FIG. 4), and a range of configurations intermediate the first and second configurations (depicted in FIG. 3). In both the first, closed configuration and the second, open configuration (which are different from one another by the cabinet sections rotating approximately 90 degrees relative to hingedly adjoining cabinet sections), each connected pair of cabinet sections is rotated with respect to one another substantially as far as it can be rotated, and the cabinet sections are drawn fully inward toward a central axis of the cabinet-section assembly, as compared to intermediate configurations that are close in configuration to the first or second configurations.

In the first configuration, each cabinet section has its second hinge line closer to the central axis than its first hinge line, and is as close to that axis as it can get. In the second configuration, each cabinet section has its first hinge line closer to the central axis than its second hinge line, and is as close to that axis as it can get. The geometry of the cabinet-section assembly dictates that the assembly transforms between the first configuration and the second configuration along only one degree-of-freedom (i.e., the rotational position of any hinge substantially dictates the position of all the other hinges), and thus the cabinet sections always move in synchrony.

In the first, closed configuration, the cabinet sections 111 are hingedly rotated to the extreme position with respect to one another such that each cabinet section's front face 135 confronts the front face of the cabinet section to which it attaches along the second hinge line 143, and thus the cabinet-section assembly substantially encloses each of the cavities. In this configuration, the exterior side panel 123 of each cabinet section is substantially coplanar with the exterior side panel of the cabinet section that it confronts, and the back panel 121 of each cabinet section is substantially coplanar with the back panel of the cabinet section to which it is hingedly attached along its first hinge line 141, thus forming an exterior lateral surface for the cabinet-section assembly as a whole. Also, the interior side panels 125 of each cabinet section are within the interior of the cabinet-section assembly in the closed configuration.

In the second, open configuration, the cabinets sections 111 are hingedly rotated to an extreme position with respect to one another such that each cabinet section's front face 135 is externally exposed. In this configuration, the exterior side panel 123 of each cabinet section is substantially, or at least approximately, coplanar with the exterior side panel of the cabinet section to which it is hingedly attached along its first hinge line 141, and the front face 135 is substantially or approximately coplanar with the front face of the cabinet section to which it is hingedly attached along its second hinge line 143, thus forming an open-faced exterior for the cabinet-section assembly as a whole. Also, the back panel 121 of each cabinet section confronts the back panel of the cabinet section to which it is hingedly attached along its first hinge line 141.

The support body is configured to support the cabinet-section assembly. The base 103 and central pole 105 are rigidly attached to one another, with the central pole extending vertically upward along the central axis and through the cabinet-section assembly to a position above the cabinet-section assembly. The hub 107 is affixed to the top of the central pole such that it is allowed to move in only one degree-of-freedom, being a rotational movement around the central axis with respect to the central pole and base. The base 103 is broad enough to prevent significant lateral tipping of the central pole 105.

The support body is configured to bias the cabinet-section assembly to move to either the first configuration or the second configuration from every configuration intermediate the first and second configurations. To this end, each cabinet section 111 of the cabinet-section assembly is gravitationally suspended from the hub 107 of the support body by one of the connectors 109. More particularly, each connector 109 extends from a hub tether point on the hub 107 to a cabinet-section tether point 145 on the top panel 127 of the cabinet section 111.

In all of the intermediate configurations, the cabinet-section tether point 145 of each cabinet section 111 is farther from the central axis than it is in the open or closed configurations, and more particularly, the cabinet-section tether point is farther than it is from the more closely associated configuration of the open and closed configurations. The connector that connects each cabinet section to the hub is as close as, and preferably is closer to, the central axis at the point where it connects to the hub, as compared to where it connects to the cabinet section.

Because of this geometry, the cabinet-section assembly is characterized by an offset suspension, such that the cabinet-section assembly is slightly raised with respect to gravity when transforming from the first or second configurations to one of the nearby intermediate configurations. Thus, each intermediate configuration has a greater gravity-based potential energy than the respective first or second configuration toward which the cabinet-section assembly is biased to move from that intermediate configuration.

The amount of the restoring force (i.e., the bias) for any intermediate configuration is geometrically related to the angle of offset in the respective end configuration (i.e., the first or second configuration toward which the intermediate configuration is biased), and to the additional angle of offset developed in transitioning from the end configuration to the intermediate configuration. The offset in the end configurations is therefore preferably selected to provide a restoring force adequate to drive the cabinet assembly into the end configurations, and yet low enough to provide for ease of actuation by a person wishing to open the cabinet. To minimize the variation in bias over the range of possible intermediate positions, longer connector lengths can be used.

Preferably, the cabinet-section tether point is in the center of the cabinet section. In cases where it is likely that the center of gravity of the cabinet section will be off center when loaded, it might be preferable for the cabinet-section tether point to be over the likely center of gravity of the loaded cabinet section, thereby limiting unnecessary loading of the hinges. Preferably, each connector is a chain, a cable, a flexible line, or a rod with a joint at each end to allow for rotational movement of the rod with respect to the hub and the cabinet section.

The open-faced exterior of the cabinet-section assembly in the second position includes two cabinet sections facing open in a first lateral direction, and two cabinet sections facing open in the opposite lateral direction. Access to the various cabinet sections is made simple by the rotational degree-of-freedom of the hub with respect to the central pole and base, which allows the entire cabinet-section assembly to be rotated while in either the first, closed configuration or the second, open configuration.

The cabinet is also provided with one or more (and preferably two) stabilizing brackets 151 that are configured to provide lateral support to the cabinet-section assembly so that it doesn't laterally swing during transition between the open and closed configurations, or when the cabinet-section assembly is rotated. The two stabilizing brackets are vertically spaced along the dimension of the central axis within the cabinet-section assembly, thereby providing lateral support to the cabinet-section assembly at different heights.

Each stabilizing bracket 151 is a relatively straight body having a first anchor point at a first end 153, which is connected to a laterally central portion of the interior side panel 125 of a first cabinet section 155, and a second anchor point at a second end 157, which is connected to a laterally central portion of the interior side panel 125 of a second cabinet section 159. More particularly, each bracket end connects to the interior side panel half way between the two hinge lines. These first and second cabinet sections are not directly connected to one another at a hinge line, and are on opposite sides of the cabinet-section assembly.

Each stabilizing bracket 151 defines a hole 161 centered between the two ends 153, 157, the center hole conforming to and being received around the central pole 105. The center hole has a large enough clearance around the central pole to provide free rotation of the stabilizing bracket around the central pole.

The stabilizing brackets restrict the first and second cabinet sections from laterally swinging with respect to the central axis, and the first and second cabinet sections likewise restrict the other two cabinet sections. Thus, the stabilizing brackets are hidden from view, connect the cabinet-section assembly to the central pole, and allow free rotation of the cabinet sections with respect to one another and with respect to the base and pole.

The cabinet sections can be sized and the number of intermediate shelves selected for any of a wide variety of intended applications. Included among the applications within the scope of the invention are cabinets configured to hold compact disks, digital video disks, videocassette recorder tapes, books, spices and cosmetics.

In use, the above-described cabinet, when in the closed position, may be opened by grasping any two cabinet sections and actuating them with respect to one another to overcome the bias mechanism and alter the configuration through the intermediate configurations to simultaneously turn them inside out (with respect to the closed configuration) to the open configuration. Likewise, when in the open position, the cabinet may be closed by grasping any two cabinet sections and actuating them with respect to one another to overcome the bias mechanism and alter the configuration through the intermediate configurations to the closed configuration.

It is to be understood that the invention comprises cabinet apparatus and related methods for using and producing cabinets. Alternative variations of these embodiments could comprise other types of cabinets. In short, the above-disclosed features can be combined in a wide variety of configurations within the anticipated scope of the invention.

While particular forms of the invention have been illustrated and described, it will be apparent that various modifications can be made without departing from the spirit and scope of the invention. For example, while the recited embodiment was comprised of four relatively square cabinet sections of similar configuration (differing only by being mirror images) that moved with one degree-of freedom in synchrony, other numbers of cabinet sections (e.g., six or twelve sections) having other shapes (e.g., triangular) and/or a plurality of different cabinet-section shapes (e.g., triangular and square) and with additional degrees of freedom are within the scope of the invention.

Likewise, while the support body was described as a base, a central pole and a hub, the support body could alternatively be configured to be wall mounted or ceiling mounted. While the connectors were described as being separate devices for each cabinet section, they could likewise be one integral unit having a plurality of lower connections and a single or different number of upper ends (similar to a macraméplant hanger). Furthermore, while the disclosed bias mechanism was described as gravitationally-driven and disclosed to be based on the offset suspension of the cabinet sections, other forms of biased mechanisms (either gravitationally-driven or not), such as using springs, cams, gears and the like, are also within the broadest scope of the invention.

Thus, although the invention has been described in detail with reference only to the preferred embodiments, those having ordinary skill in the art will appreciate that various modifications can be made without departing from the scope of the invention. Accordingly, the invention is not intended to be limited by the above discussion, and is defined with reference to the following claims.

What is claimed is:

1. A cabinet, comprising:

a cabinet-section assembly including a plurality of cabinet sections, each cabinet section defining a first and second hinge line, wherein each cabinet section, at its first hinge line, is hingedly attached to another cabinet section at its first hinge line, and each cabinet section, at its second hinge line, is hingedly attached to another cabinet section at its second hinge line, such that the plurality of cabinet sections form a complete circuit of interconnected cabinet sections; and a support body configured to support the cabinet-section assembly;

wherein the cabinet-section assembly is characterized by a closed configuration, an open configuration, and a plurality of configurations intermediate the closed and open configurations, the closed and open configurations being different from one another, and each of the closed and open configurations being characterized by the cabinet sections' being drawn toward a central axis of the cabinet-section assembly;

wherein the support body is configured to bias the cabinet-section assembly to move to either the closed configuration or the open configuration from said plurality of configurations intermediate the closed and open configurations;

wherein the support body bias is gravitationally driven; and wherein each cabinet section of the cabinet-section assembly is gravitationally suspended from a hub of the support body such that each intermediate configuration has a greater gravity-based potential energy than the respective closed or open configuration to which the cabinet-section assembly is biased to move from that intermediate configuration.

2. The cabinet of claim 1, wherein for each cabinet section, the cabinet section is characterized by four lateral sides that are parallel to the first and second hinge lines and in a substantially square configuration, and by a top and bottom that are normal to the first and second hinge lines and on opposite vertical ends of the four lateral sides.

3. The cabinet of claim 2, wherein three of the lateral sides are closed and one of the lateral sides are open.

4. The cabinet of claim 1, wherein for each cabinet section:

the cabinet section is characterized by a plurality of lateral sides that are parallel to the first and second hinge lines; and the first hinge line and the second hinge line extend parallel to one another on opposite edges of one of the lateral sides.

5. The cabinet of claim 1, wherein:

each cabinet section defines a cavity;

in the closed configuration, the cabinet-section assembly substantially encloses the cavity; and in the open configuration, the cavity is externally exposed.

6. The cabinet of claim 1, wherein each cabinet section is connected to the hub by a connector that is closer to the central axis where it connects to the hub than where it connects to the cabinet section.

7. The cabinet of claim 6, wherein the connector is selected from the group of a chain, a cable, a flexible line, and a rod with a joint.

8. The cabinet of claim 1, and further including a stabilizing bracket laterally supporting the cabinet-section assembly.

9. The cabinet of claim 8, and further including a second stabilizing bracket configured to provide lateral support to the cabinet-section assembly, the first and second stabilizing brackets being spaced along the dimension of the central axis.

10. The cabinet of claim 8, wherein:

for each cabinet section, the cabinet section is characterized by four lateral sides that are parallel to the first and second hinge lines and in a substantially square configuration;

for each cabinet section, the first hinge line and the second hinge line extend parallel to one another on opposite edges of a first side of the four lateral sides; and the stabilizing bracket interconnects the first side of a first cabinet section with the first side of a second cabinet section directly across the central axis from the first cabinet section.

11. The cabinet of claim 1, wherein the cabinet-section assembly in the closed configuration or the open configuration is configured to rotate with respect to the support body.

12. The cabinet of claim 1, wherein each cabinet section includes shelves that are sized to hold at least one item type from the group of item types consisting of compact disks, digital video disks, video cassette recorder tapes, books, spices and cosmetics.

13. The cabinet of claim 1, wherein the plurality of cabinet sections includes a first plurality of cabinet sections and a second plurality of cabinet sections;

each cabinet section of the first plurality of cabinet sections, at its first hinge line, is hingedly attached to one of the second plurality of cabinet sections at its second hinge line;

each cabinet section of the second plurality of cabinet sections, at its first hinge line, is hingedly attached to one of the first plurality of cabinet sections at its second hinge line;

in the cabinet-section-assembly closed configuration, the first plurality of cabinet sections has their respective first hinge lines closer to the central axis than their respective second hinge lines;

in the cabinet-section-assembly open configuration, the first plurality of cabinet sections has their respective second hinge lines closer to the central axis than their respective first hinge lines;

for each cabinet section, the cabinet section is characterized by four lateral sides that are parallel to the first and second hinge lines and in a substantially square configuration, and by a top and bottom that are normal to the first and second hinge lines and on opposite vertical ends of the four lateral sides;

for each cabinet section, three of the lateral sides are closed and one of the lateral sides is open;

each cabinet section is connected to the hub by a connector that is closer to the central axis where it connects to the hub than where it connects to the cabinet section; and the cabinet-section assembly in the second open configuration is configured to rotate with respect to the support body.

14. The cabinet of claim 13, and further including first and second stabilizing brackets, being spaced along the dimension of the central axis, each stabilizing bracket interconnecting the first side of a cabinet section with the first side of another cabinet section directly across the central axis.

* * * * *